United States Patent [19]

Goudsmit

[11] 4,346,493

[45] Aug. 31, 1982

[54] DENTAL-CARE DEVICE AND BRUSH BODY SUITABLE THEREFOR

[76] Inventor: Johan H. Goudsmit, Rijnsburgerweg 48, 2333 AB Leiden, Netherlands

[21] Appl. No.: 81,921

[22] Filed: Oct. 4, 1979

[30] Foreign Application Priority Data

Oct. 10, 1978 [NL] Netherlands ..... 7810204

[51] Int. Cl.[3] ..... B08B 1/00; A46B 9/04

[52] U.S. Cl. ..... 15/104.93; 15/167 R; 15/187; 424/49; 424/52; 426/104

[58] Field of Search ..... 15/186–188, 15/167 R, 167 A, 104.92, 104.93, 104.94; 424/52; 426/104, 91, 132, 134, 420

[56] References Cited

U.S. PATENT DOCUMENTS

| | | | |
|---|---|---|---|
| 2,140,294 | 12/1938 | Loeffler | 15/167 A |
| 2,778,045 | 1/1957 | Bly et al. | 15/167 R X |
| 3,070,102 | 12/1962 | MacDonald | 15/104.94 |
| 3,120,670 | 2/1964 | Amodeo | 15/159 R X |
| 3,151,028 | 9/1964 | Hay | 424/55 |
| 3,231,925 | 2/1966 | Conder | 15/104.94 |
| 3,378,870 | 4/1968 | Matsunaga | 15/104.94 |
| 3,853,412 | 12/1974 | Griffin | 15/104.93 |
| 3,959,842 | 6/1976 | Alley | 15/167 R |
| 4,157,386 | 6/1979 | La Rochelle | 424/52 |

FOREIGN PATENT DOCUMENTS

| | | | |
|---|---|---|---|
| 2648289 | 4/1978 | Fed. Rep. of Germany . | |
| 158341 | 10/1919 | United Kingdom | 15/167 R |
| 1091550 | 11/1967 | United Kingdom | 15/104.94 |

*Primary Examiner*—Peter Feldman

*Attorney, Agent, or Firm*—Irvin A. Lavine

[57] ABSTRACT

A dental care device which encourages more frequent tooth cleaning. The device comprises a brush body consisting of a brush core provided with bristle members, which brush body is surrounded in full or in part by a solid, palatable mass of physiologically acceptable materials. The device has the appearance of, and is to be treated as, a sweet.

8 Claims, 13 Drawing Figures

DENTAL-CARE DEVICE AND BRUSH BODY SUITABLE THEREFOR

This invention relates to a means for dental care. It is well-known that brushing the teeth is essential for good oral hygiene, as this can remove bacterial plaque, which is responsible for dental decay and inflammation of the gums.

Many types of toothbrushes are commercially available, with which, when they are used properly, excellent dental care can be practiced. Disposable toothbrushes are also known.

Belgian patent specification No. 830,037, for example, describes a disposable toothbrush which, instead of bristles, has a spongy mass of, e.g. polyurethane foam, filled with toothpaste.

U.S. Pat. No. 2,763,885 describes a disposable toothbrush without a handle, which instead of bristles comprises a cellular brush body filled with toothpaste. The brush must be stuck to a finger before use and moved over the teeth with the finger.

German Offenlegungsschrift No. 2.648.289 describes a disposable toothbrush of soft synthetic plastics material, the head of which is enveloped in a candy composition. In the portion of the handle located adjacent to the head, there is provided a space filled with toothpaste. To enhance its vendibility, the candy composition contains caries-producing components, such as saccharose. The adverse effects thereof must be counteracted by using the brush further, after the candy composition has been consumed, by brushing with toothpaste.

French patent application No. 2,341,301 discloses a disposable dental-care device in the form of a cellular rod, the cells of which are filled with toothpaste components, such as fluoridation agents and flavourings. During use, the device must be manipulated with the fingers or by means of a handle.

Unfortunately it is found that, in spite of good instruction by, for example, dentists and oral hygienists, most people brush their teeth poorly, that is to say carelessly and too hastily, and insufficiently frequently. Examples of causes thereof are laziness, lack of time and lack of opportunity to brush the teeth (when travelling or at work).

Apart from the disadvantage of the complex and hence expensive handle structure, already pointed out in the introductory part of Belgian patent specification No. 830,037, the toothbrush described in the German Offenlegungsschrift No. 2,648,289, like those disclosed in Belgian Pat. No. 830,037 and U.S. Pat. No. 2,763,885, has the drawback that it does not invite more frequent brushing of the teeth than does an ordinary toothbrush. Drawbacks of the dental care device described in French patent application No. 2,341,301 are its complex construction, its poor cleaning effect as a result of the absence of bristles, and its manner of manipulation, which is unsuitable for use in company.

It is an object of the present invention to make the care of one's teeth a pleasant occupation, which is not tied down to time or place, so that a much larger number of people take proper care of their teeth than is now the case.

This object is realised by the dental-care device according to the present invention, which is characterized by a brush body comprising a brush core provided with bristle members, which brush body is surrounded in full or in part by a solid, palatable composition of physiologically acceptable materials.

For that matter, known per se from Dutch patent application No. 71,11495 is a brush comprising bristles and having a particular construction, which brush can be used as a travelling means in various devices, and also for cleaning and massage purposes. There is no reference to its being used as a dental care device, nor is there any mention of an enveloping solid palatable mass of physiologically acceptable materials.

The present invention makes possible a pleasant manner of taking care of the teeth by providing a dental care device which looks like a sweet, and must be treated as one. It is certainly surprising that a combination of actions which are deemed contradictory, dental care on the one hand and eating sweets on the other, leads to an increase of the possibilities of caring for the teeth, and thereby to an improvement of dental care.

When the user chews the dental care device according to the present invention like chewing gum and plays with it in the mouth, his teeth are thereby brushed and his gums massaged.

For reasons of manufacturing technique and economy, the brush core and the bristle members are preferably made in one piece. When the brush body is made of synthetic plastics material, preferably a mixture of polyethylene and polypropylene, it can be made, for example, by injection moulding. It is also possible, however, to make a brush body by securing bristle members in known manner in a brush core. In that case the bristle members and the brush core may be made of different materials. It is not critical of what materials the brush body is made, provided they are not toxic materials. Indeed, the material can be selected depending on the desired characteristics of the brush body. In order that the brush body may be acceptable for most people it is desirable for it to consist of a relatively small brush core with soft, pliable bristle members, which however are still sufficiently rigid for them to be able to exercise a cleaning action. The material should further be so tough and/or hard that the brush body remains intact in the mouth.

Preferably the brush body comprises radiopaque material so that an aspiration, that is to say, if the brush body accidentally finds its way into the respiratory tract, the position of the brush body can be determined by means of X-rays. This radiopaque material may consist of salts containing heavy metals, iodine and the like, which may be added as a powder to the starting material for making the brush body, but may also be a piece of metal accommodated in the brush body. Also the brush body may be made of a material which slowly dissolves in water, which is advantageous in case the brush body should accidentally be swallowed. In connection with the acceptance by the user, it is recommendable to include flavours in the material for the brush body. Furthermore it is desirable that the brush body is coloured.

In a preferred embodiment of the dental care device according to the invention, the brush core is provided with a space which can be sucked to generate a partial vacuum therein. This enables the user to more readily manipulate the brush body, for example, by sucking it fast to the tongue. This space may be formed by a cavity in the brush core, but also by a hollow projection connected to the brush core.

Preferably the dental care device according to the invention is a brush body enveloped in an edible mass without a handle, but an embodiment which resembles a lollipop, in which the edible envelope or the brush body is provided with a loose or a fixed handle, is possible.

The brush body according to the invention may have all kinds of forms. Thus, for example, the brush core may have the form of a rectangular, square, oval or circular plate, provided on one or both sides with bristle members. The bristle members may be distributed over the surface at random or in a particular pattern. A rectangular or square plate, as used herein, should be understood to include one that is substantially rectangular or square, but has rounded corners.

In a preferred embodiment of the invention, the brush core has the form of a square plate having rounded corners or a round plate and it is provided on one side thereof with bristle members, there being provided a projection with an open cavity therein on the same side. Preferably, this projection projects above the bristle members, and it may have a round, square, triangular or other cross-sectional configuration. The bristle members are preferably arranged in rows of bristle members.

A "row of bristle members" as used herein means a row-shaped formation of bristle members, which may be more than one bristle member in width.

This embodiment is the one most preferred, because the manufacturing of the brush body, for example, by injection moulding, is technically easy, it has an excellent cleaning effect, and can be readily manipulated in the mouth.

In another preferred embodiment of the invention, the brush core has the form of a rectangular plate, and it is provided on one side thereof with two rows of bristle members parallel to the longer side of the plate-shaped core.

The advantage of that embodiment is that the user can let the brush body, as it were, ride over his teeth.

In still another preferred embodiment of the invention, the brush core has the shape of a rectangular plate and it is provided on both sides with two rows of bristle members parallel to the longer side of the plate-shaped core. That embodiment is beneficial on account of its effective brushing action.

In yet another preferred embodiment of the invention the brush core has the shape of an oval or circular plate, and it is provided on both sides with a peripherally extending row of bristle members. That embodiment had the advantage that places in the mouth which normally are difficult of access can be readily reached with it.

In still another preferred embodiment of the invention the brush core is rod-shaped or of ovoid, cylindrical or spherical shape and provided with bristle members arranged in one or more rows of distributed at random over the circumference of the core. The advantage of these embodiments is that the brush core may be relatively small, while yet providing a large brush surface area. Preferably the brush core is hollow with an opening through which the user can generate a partial vacuum in the cavity by sucking in the mouth.

According to yet again another preferred embodiment, the brush core consists of two parallel plate-shaped core sections interconnected by a rod-shaped or plate-shaped bridge, with the bristle members being provided on the facing surfaces of the plate-shaped core sections. The core sections may for example, have the form of rectangular, square, oval or circular plates. These embodiments have the advantage of a nice "feel" in the mouth, as there are no outwardly projecting bristle members.

In another preferred embodiment the brush core is a hollow body having an opening therein, and provided on the inside or the outside with bristle members. The brush core may have various shapes, for example, the shape of a hollow cylinder longitudinally cut through. Such embodiments have the advantage that the brush body can be moved with ease in the mouth. When the bristle members are provided on the inside, the teeth are brushed on both sides at the same time.

The dimensions of the brush body according to the invention are not critical. In connection with acceptance by the user, shapes whose largest dimension is 1.5–2.5 cm, preferably approximately 2.0 cm, are preferred.

The brush core or parts thereof can be rigid, flexible or elastic, depending on the shape of the core and the user's wishes.

The bristle members to be used according to the invention can have all kinds of known forms. Depending on the user's wishes they may be long or short, hard or soft, thin or thick, optionally have a rounded tip, or consist of a plurality of elements. Preferably they have a triangular cross-sectional configuration.

The solid palatable composition which surrounds the brush body in full or in part, preferably consists of non-caries-producing candy components and/or dentifrice components. Such components are well-known per se to those skilled in the art. Known dentifrice components are, for example, abrasives and polishing agents, such as calcium carbonate, dicalcium phosphate dihydrate, anhydrous dicalcium phosphate, tricalcium phosphate, calcium pyrophosphate, aluminium hydroxide, insoluble sodium methaphosphate, hydrated silicon dioxide and globules of polymethacrylate; detergents such as potassium or sodium palmitate and stearate, sodium lauryl sulfate, sodium-n-lauroyl sarcosinate; flavours and sweeteners such as peppermint oil, oil of cloves, eucalyptus oil, aniseed, lavender, saccharin, chloroform; anti-drying agents such as glycerine, sorbitol 70%; binders such as tragacanth, sodium carragenate, sodium carboxymethyl cellulose, hydroxyl cellulose; bleaching agents such as sodium perborate, magnesium peroxide, hydrogen peroxide-urea-compounds and stabilized hydrogen peroxides; and therapeutics such as: 1. caries inhibitors: fluorides, hexachlorophene, tyrothricine, dichlorophenylmethane; 2. dentalplaque-formation inhibitors: chlorohexidine digluconate; 3. antiflogistics: vitamine A; 4. agents for treating sensitive tooth neck: potassium nitrate; silver nitrate and zinc chloride, organic iodine compounds, calcium hydroxide, magnesium hydroxide, fluorides, formaldehyde, strontium chloride.

The proportions are determined according to the desired activity, taste and consistency of the solid mass of physiologically acceptable materials.

Preferably the proportion of detergents is limited so as to avoid undue foam formation as takes place with normal tooth brushing. Caries producing components, such as sugars, are preferably absent or present in relatively minor quantities only. An elastic composition on the basis of, for example, gelatine, behaves most pleasant in the mouth.

In a preferred embodiment of the invention, the solid mass of physiologically acceptable materials contains dental plaque colouring agents, such as erytrosine and fuchsine, so that the user can see from the disappearance of the red colour on the teeth that he has chewed the brush body long enough.

The brush body can be provided with the solid palatable envelope in many ways. Indeed, the manner in which this is done is not critical. One efficient way of applying the envelope is immersing the brush body in the still liquid or pasty mass of the envelope components and subsequently allowing the mass around the brush body to dry and harden, possibly with heating.

It is also possible for the mass, when not yet in the solid state, to be poured over the brush body. If there is provided a projection having an open cavity therein, the non-solidified mass can be injected into it.

It is possible, and preferable, to apply masses of different compositions. Preferably the bristle members are coated with a mass principally containing toothpaste components, such as polishing agents, the cavity, if present, is filled with a mass especially containing a large amount of flavour, and the whole is surrounded by a gelatinous composition which in addition to flavours mainly contains gelatine and sugar substituents, such as sorbitol, mannitol and xylitol.

The shape of the dental-care device according to the invention is not critical. For reasons of manufacturing technique it is sometimes desirable that the shape corresponds to the shape of the brush body, but this is not of course essential.

Preferably the solid palatable mass is transparent, so that the user can see the brush body and is not faced with surprises. A coloured appearance will enhance the attractiveness for the user. A non-transparent mass, whether coloured or not, is also possible, however.

The manner of packing the dental-care device according to the invention is not critical. A suitable manner is packing in paper wrappers. For reasons of hygiene a preferred manner of packing is in transparent containers of synthetic plastics material, which can be closed for example wit aluminum foil, in which containers the palatable mass can be intoduced in unsolidified condition, either before or after the introduction of the brush bodies, and in which the mass can harden. Such containers can be combined to form a set. However, embodiments which owing to the selected consistency of the solid palatable mass require no packing at all are also possible.

The invention also relates to a brush body which consists of a brush core provided with bristle members, and suitable for the manufacture of a dental-care device according to the invention.

Some embodiments of the invention will now be described, by way of example with reference to the accompanying drawings, in which.

Figure 1:
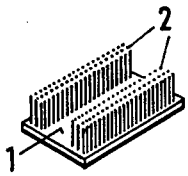
FIGS. 1–3 show several embodiments of a brush body according to the invention in perspective elevational view.

Referring more in particular to the detail of the drawing FIG. 1 shows a brush body which consists of a brush core 1 having the form of a rectangular plate, on one side of which two rows of bristle members 2 extend.

Figure 2:
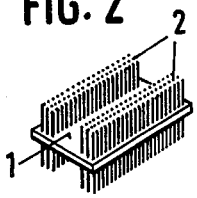

FIG. 2 shows a brush body which consists of a brush core 1 similar to that shown in FIG. 1, with two rows of bristle members 2 extending on both sides thereof.

Figure 3:
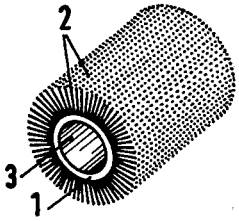

FIG. 3 shows a brush body which consists of a brush core 1 in the shape of a cylinder having an opening 3 on one side. Bristle members 2 are distributed throughout the entire outer surface of the brush core. Via opening 3, a partial vacuum can be "sucked" in the interior of the brush core in the mouth.

Figure 4:
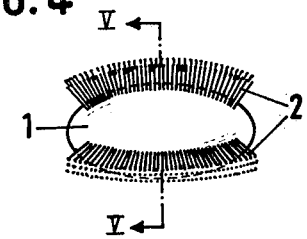
FIG. 4 shows a different embodiment in elevational view.
Figure 5:
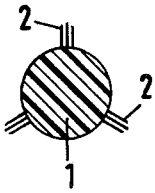
FIG. 5 shows the embodiment of FIG. 4 in cross-sectional view, taken on the line V—V of FIG. 4.

FIG. 4 shows a brush body comprising an ovoid brush core 1 with three rows of bristle members 2 thereon. The relative location of the rows of bristle members is shown in FIG. 5, which shows a cross-sectional view of this embodiment, taken on the line V—V.

Figure 6:
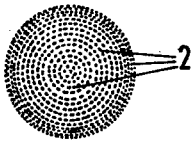
FIG. 6 shows a different embodiment in elevational view.

FIG. 6 shows a brush body having a spherical brush core, provided with bristle members 2 distributed at random over its circumference.

Figure 7:
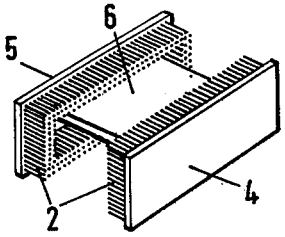
FIGS. 7–10 show still other embodiments of a brush body according to the invention in perspective elevational view.

FIG. 7 shows a brush body having a brush core consisting of two parallel core sections 4, 5 in the form of rectangular plates, which are interconnected by a plate-shaped bridge 6. Bristle members 2 extend along the edge of the core sections on the facing sides thereof.

Figure 8:
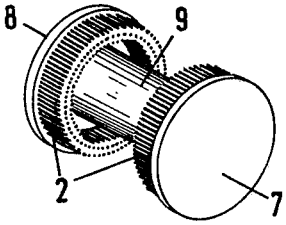

FIG. 8 shows a brush body having a brush core consisting of two parallel core sections 7, 8 in the form of circular plates interconnected by a rod-shaped bridge 9. Bristle members 2 extend along the edge of the core sections on the facing sides thereof.

Figure 9:
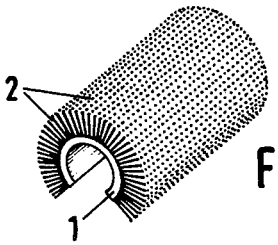

FIG. 9 shows a brush body having a brush core 1 in the form of a hollow cylinder cut through in the longitudinal direction, and having bristle members 2 distributed on its outer circumference at random.

Figure 10:
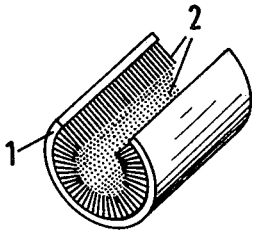

FIG. 10 shows a brush body having brush core 1 in the form of a hollow cylinder cut through in the longitudinal direction, and having bristle members 2 distributed at random over its inner surface.

Figure 11:
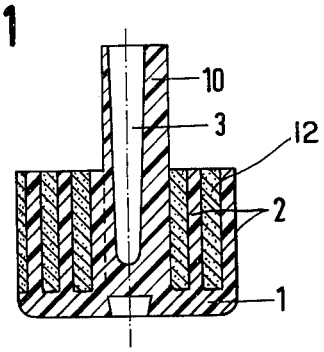
FIG. 11 shows the most preferred embodiment in cross-sectional view.
Figure 12:
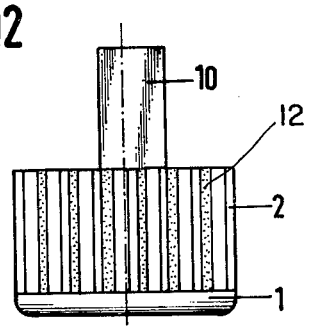
FIG. 12 shows the embodiment of FIG. 11 in front-elevational view.
Figure 13:
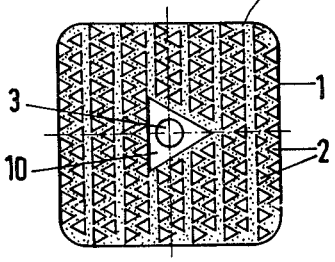
FIG. 13 shows the embodiment of FIG. 11 in plan view.

FIGS. 11–13 show the most preferred brush body. The brust core 1 here has the form of a square plate with rounded corners, and is provided on one side with bristle members 2 and with a projection 10 having an open cavity 3. Palatable mass 12 surrounds the brush body 1. The plan view shown in FIG. 13 shows that the cross-sectional configuration of both bristle members 2 and projection 10 of the preferred embodiment shown is triangular. The projection 10 will function as a manipulator, by which the device may be grasped and moved by the teeth, tongue and/or lips of the user. The cavity 3 may have a mass of material therein, to be sucked out during use of the device; this material may be flavored. Bristle members and projection may have a different cross-sectional form, however, for example, circular or square. Also, the brush core may be of different shape, e.g. the shape of a round plate. The projection may be situated in the centre or, alternatively, at a different place of the brush core.

The dimensions of the brush body in this preferred embodiment are preferably as followed:

brush core: approximately $1.8 \times 1.8 \times 0.2$ cm;

projection: approximately 2.0 cm high; side of triangle approximately 0.6 cm;

bristle members: approximately 1.0 cm high; side of triangle 0.1 to 0.2 cm.

I claim:

1. A dental care device for insertion entirely within the mouth of a human, comprising a chewable brush and a palatable mass, said chewable brush being made of non-edible pliable and resilient material, and comprising a single support body having bristles and a projection extending in substantially the same direction from the same side thereof, said device having such dimensions that the entire device can be readily inserted into the mouth of a human and manipulated within the mouth of a human by chewing upon the pliable and resilient projection, said palatable mass coating said brush at least in part, and being substantially free of adhesive material, whereby introduction of the device will be encouraged by the palatable mass.

2. The dental care device of claim 1, wherein said brush body and said bristles are of one piece.

3. The dental care device of claim 1 or 2, wherein said supporting means is plate-shaped.

4. The dental care device of claim 1, said projection having an open cavity extending thereinto from said end thereof.

5. The device of claim 1, said device being substantially free of caries producing material.

6. The dental care device of claim 1, said projection having an end opposite said body beyond the ends of said bristles.

7. The dental care device of claim 1, said palatable mass being a non-caries producing candy.

8. A dental care device for insertion entirely within the mouth of a human for effecting a cleaning action by bristles on tooth surfaces by chewing comprising:

(a) a chewable brush of non-edible pliable, resilient material (b) said brush comprising:

(i) a single support body, (ii) bristles extending from a surface of said support body only substantially in the same direction, and (iii) a pliable and resilient projection extending from said surface of said support body, substantially in the same direction as said bristles, (c) said brush having such dimensions that it can be inserted entirely into the human mouth and manipulated within the mouth by chewing upon the pliable and resilient projection.

* * * * *